US009688452B1

(12) United States Patent
Ross

(10) Patent No.: US 9,688,452 B1
(45) Date of Patent: Jun. 27, 2017

(54) INFLATABLE CUSHIONING WRAP FOR DELICATE OBJECTS SHIPPED IN A BOX

(71) Applicant: Gary Ross, Oxnard, CA (US)

(72) Inventor: Gary Ross, Oxnard, CA (US)

( * ) Notice: Subject to any disclaimer, the term of this patent is extended or adjusted under 35 U.S.C. 154(b) by 0 days.

(21) Appl. No.: 14/185,789

(22) Filed: Feb. 20, 2014

Related U.S. Application Data

(60) Provisional application No. 61/767,734, filed on Feb. 21, 2013.

(51) Int. Cl.
*B65D 81/05* (2006.01)
*B65D 5/50* (2006.01)
*B65B 55/20* (2006.01)

(52) U.S. Cl.
CPC ..... *B65D 81/052* (2013.01); *B65B 55/20* (2013.01); *B65D 5/5028* (2013.01)

(58) Field of Classification Search
CPC .. B65D 5/5076; B65D 5/5085; B65D 5/5028; B65B 55/20
USPC ..... 206/522; 53/449, 472
See application file for complete search history.

(56) References Cited

U.S. PATENT DOCUMENTS

| | | | | |
|---|---|---|---|---|
| 3,889,743 | A * | 6/1975 | Presnick | 165/46 |
| 5,217,131 | A * | 6/1993 | Andrews | B65D 81/052 206/522 |
| 2003/0006162 | A1* | 1/2003 | Smith | 206/522 |
| 2006/0278554 | A1* | 12/2006 | Tanaka et al. | 206/522 |
| 2007/0221530 | A1* | 9/2007 | Lee | 206/522 |
| 2009/0117236 | A1* | 5/2009 | Watzke | B65D 81/03 426/106 |
| 2013/0048529 | A1* | 2/2013 | Liao et al. | 206/522 |

* cited by examiner

*Primary Examiner* — Anthony Stashick
*Assistant Examiner* — Robert Poon
(74) *Attorney, Agent, or Firm* — Thomas I. Rozsa

(57) ABSTRACT

A new and novel packaging system in which an inflated bellows or bladder system is inflated around a fragile item such as a glass drinking vessel and conforms to the shape of the item so that it is securely restrained within its shipping box to prevent the object from moving while the box is shipped. The fragile item moves to the center of the box when the air bladder is inflated with air around the fragile item. As the pressure increases, the bladder will hold the item in the center of the box. A one-way check valve extends from the bladder to a location in a hole in the box or out of the box so that bladder can be easily filled. When the package arrives at its destination, a kinked tube is relaxed to allow air to leave the bladder to remove the object.

4 Claims, 6 Drawing Sheets

INFLATABLE CUSHIONING WRAP FOR DELICATE OBJECTS SHIPPED IN A BOX

This patent application claims priority to Provisional Application No. 61/767,734 filed on Feb. 21, 2013.

BACKGROUND OF THE INVENTION

1. Field of the Invention

The present invention relates to the field of shipping delicate objects such as glass in a box and providing adequate cushioning to increase the probability that the delicate object will not be damaged or broken during shipment of the box.

2. Description of the Prior Art

Different methods of packaging are known in the prior art but these all have flaws that do not insure that a delicate object such a glass or ceramic drinking container will not be broken during shipment. One method is bubble wrapping. A second method is to fill the box with styrofoam pellets. A third method is to inflate cushions with air and fill the box with inflated cushions around the object. There are problems with each of these methods.

Bubble wrapping is time consuming and the object can still move within the box during shipment. Styrofoam pellets are messy and leave a mess at the destination when the box or package is opened. The use of inflated cushions does not secure the item in the box and therefore, does not isolate the item by a sufficient amount to avoid it moving in the box and breaking during shipment.

There is a significant need for an improved packaging material to prevent the delicate object from bouncing around and breaking when the box containing the delicate item is shipped.

SUMMARY OF THE INVENTION

The present invention is a new and novel packaging system in which an inflated bellows system is inflated around a fragile item such as a glass drinking vessel and conforms to the shape of the item so that it is securely restrained within its shipping box to prevent the object from moving during shipment of the box. Preferably the fragile item is positioned in the center of the box and held in place while the present invention air bladder is inflated with air around the item. As the pressure increases, the bladder will hold the item in the center of the box. If the box is not large enough to suspend the item, an air bladder pillow can be inserted in the box both above and below the item. A one-way check valve extends from the bladder to a location outside the box so that the bladder can be filled with air. With a one-way check valve, the air cannot exit the bladder. Therefore, in addition to the bladder there is added a kinked tube inserted into a different location in the bladder, which kink prevents the bladder from deflating but upon arrival, an owner can un-kink the tube and therefore air can be removed from the bladder so that the bladder is deflated.

It is an object of the present invention to provide an inflatable air cushioning insert to surround and conform to the shape of a fragile item in a box so that the item is securely restrained and will not move while the box is shipped from one location to another, to prevent the fragile item from moving and being broken during shipment.

It is a further object of the present invention to provide a one-way check valve to fill the bladder and a tube which extends out from the inflatable bladder to out of the shipping box so that the air bladder can be deflated when the package arrives at its destination to enable the fragile item to be easily removed from its package.

Further novel features and other objects of the present invention will be apparent from the following detailed description, discussion and the appended claims taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

As illustrated in FIGS. 1 through 6, the present invention is a new and novel packaging system in which an inflated bellows system is inflated around a fragile item such as a glass drinking vessel and conforms to the shape of the item so that it is securely restrained within its shipping box to prevent the object from moving while the box is shipped. The fragile item is positioned near or adjacent the center of the inflatable bellows and held in place while the present invention air bladder (also called an inflatable bellows) is inflated with air around the item. As the pressure increases, the bladder will center and will hold the item in the center of the box and also the center of the inflatable bellows. If the box is not large enough to suspend the item, an air bladder pillow can be inserted in the box both above and below the item. A one-way check valve extends from the bladder to a location out of the box so that bladder can be inflated when in use. It can be deflated when the package arrives at its destination to facilitate removal of the item with a kinked straw.

Figure 1:
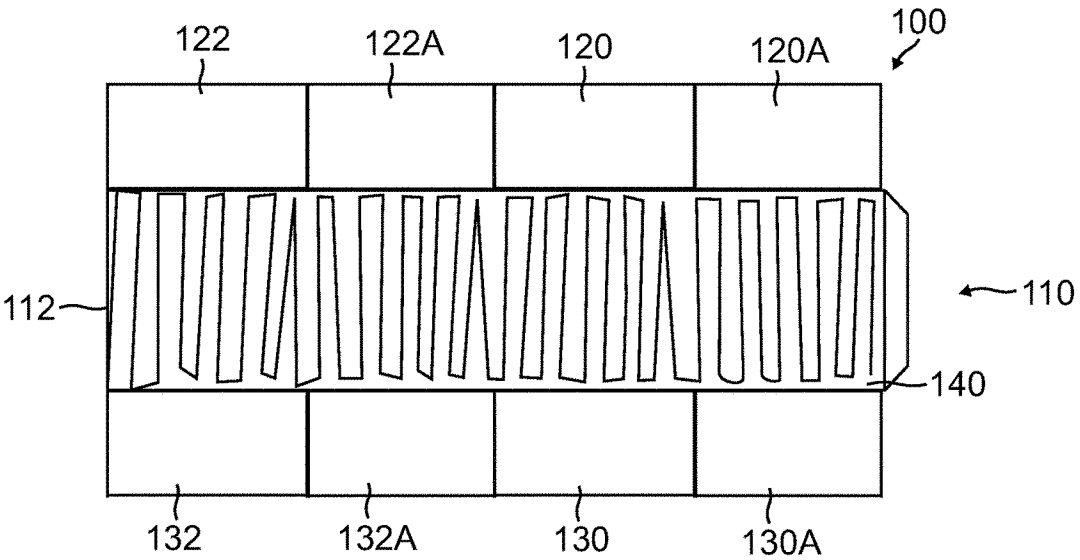
FIG. 1 is a top plan view of a die cut unfolded shipping box with the present invention air bladder in the deflated condition and affixed to a lengthwise section which forms the sidewalls of the shipping box.

FIG. 1 is a top plan view of a die cut unfolded shipping box 100 with a lengthwise section 110 which becomes the sidewalls of the box 200 when it is folded and a first top section 120 and 120A and a second matching top section 122 and 122A which form the top of the box when folded and a first bottom section 130 and 130A and a second matching bottom section 130 and 132A which form the bottom of the box when folded. The tube 110 is pulled to extend to opposite end 112 and sealed to opposite end 112 to be close to the sidewall 140. The present invention inflatable bladder or bellows 10 (See FIG. 2) is illustrated affixed to the lengthwise section 110 of the shipping box 100. The present invention bellows 10 can be made of folded inflatable polyethylene.

Figure 2:
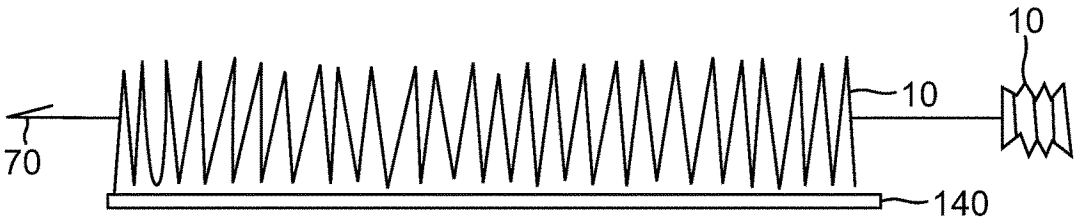
FIG. 2 is a side elevational partially exploded view of the present invention air bladder in the deflated condition and affixed to a lengthwise section which forms the sidewalls of the shipping box, a portion of the inflatable bladder illustrated to the side of the box section.
Figure 2A:
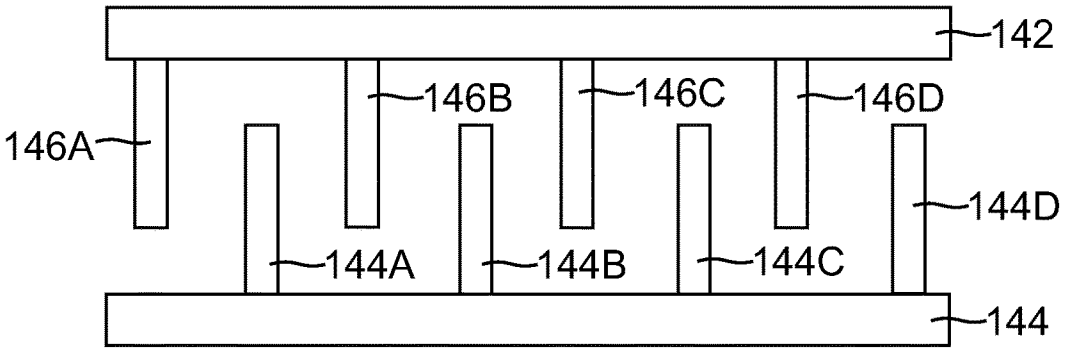
FIG. 2A is a side elevational view of a top and bottom of a box having posts around which the deflated bladder is wrapped.
Figure 2B:
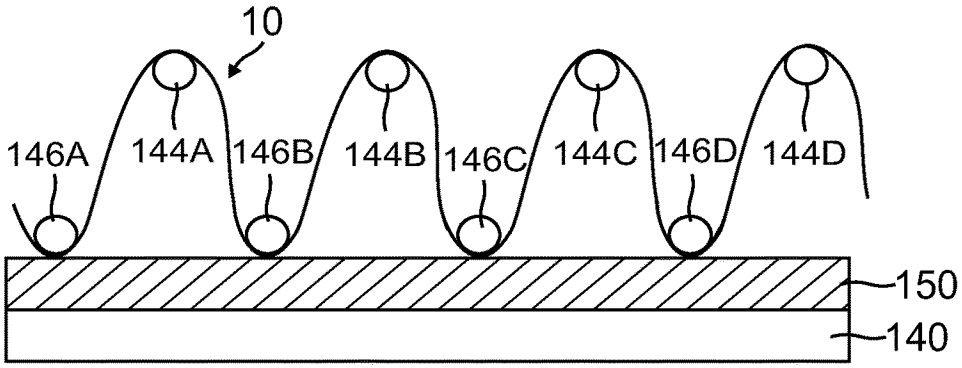
FIG. 2B is a top plan view showing the sidewall of a box with the bladder adhered to the box through adhesive and the inflatable bladder affixed to the sidewall by adhesive and wrapping around the various posts to give it the zigzag pattern as illustrated in the various other drawings.

FIG. 2 is a side elevational partially exploded view of the present invention air bladder 10 in the deflated condition and affixed to a lengthwise section 140 which forms the sidewalls of the shipping box 100, A portion of the inflatable bladder 10 is illustrated to be affixed to the side of the box 140. In more detail, FIG. 2A shows a multiplicity of posts 144A through 144D affixed to the bottom wall 144 and additional matching posts 146A through 146D affixed to the top wall 142 of the box so that the bellows 10 goes around the post and is fixed to the sidewall 140 at locations as shown through adhesive 150. FIG. 2A shows a multiplicity of rods or posts 144A through 144D to illustrate a typical manufacturing method. One row of rods move upward or downward with a roll of thin plastic as shown in 2B. The downward stroke pushes the plastic to a pressure sensitive adhesive 150 or some other instant glue method on the cardboard. Any tube or one way valves are inserted and the tube ends are cut and sealed with typical machinery. The box can then move to be finished with the glue flap as typical corrugated box construction.

To use, the user just pumps air into the bladder while holding the fragile object 300 in the center of the box (when the box is assembled). As the pressure increases, it will suspend any item in the center of the box 100. A professional packing house will have a special air hose or an individual may have a hand pump to pump air into the bladder.

Figure 3A:
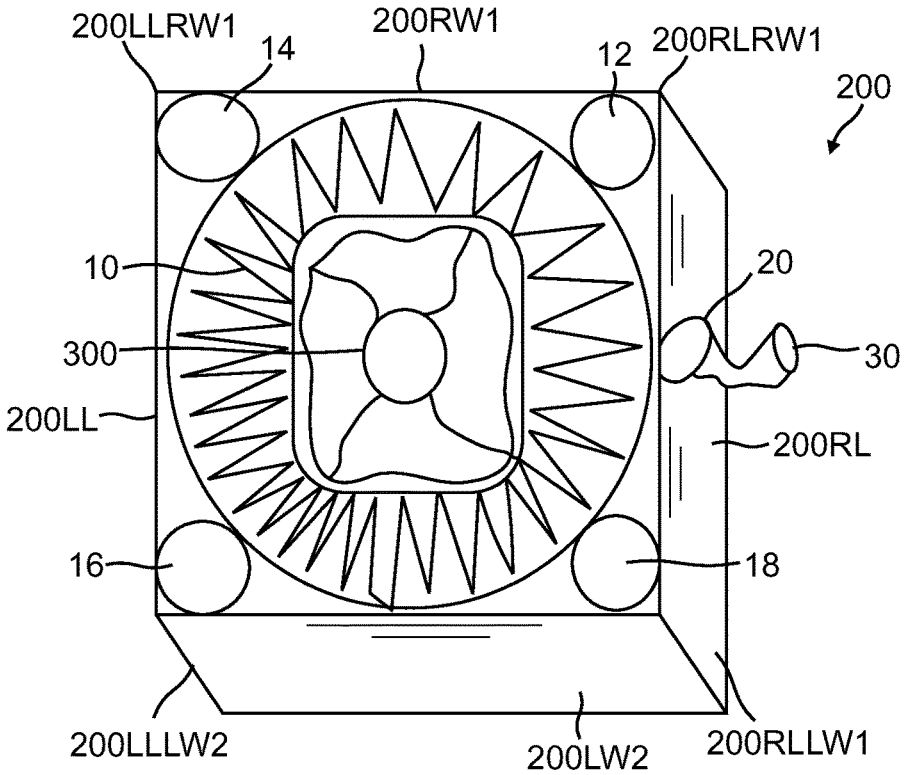
FIG. 3A is a top plan view of a box in the assembled condition with the cover removed to illustrate the present invention inflated air bladder surrounding a fragile object with balloon bumps located at four corners of the inflated air bladder.
Figure 4:
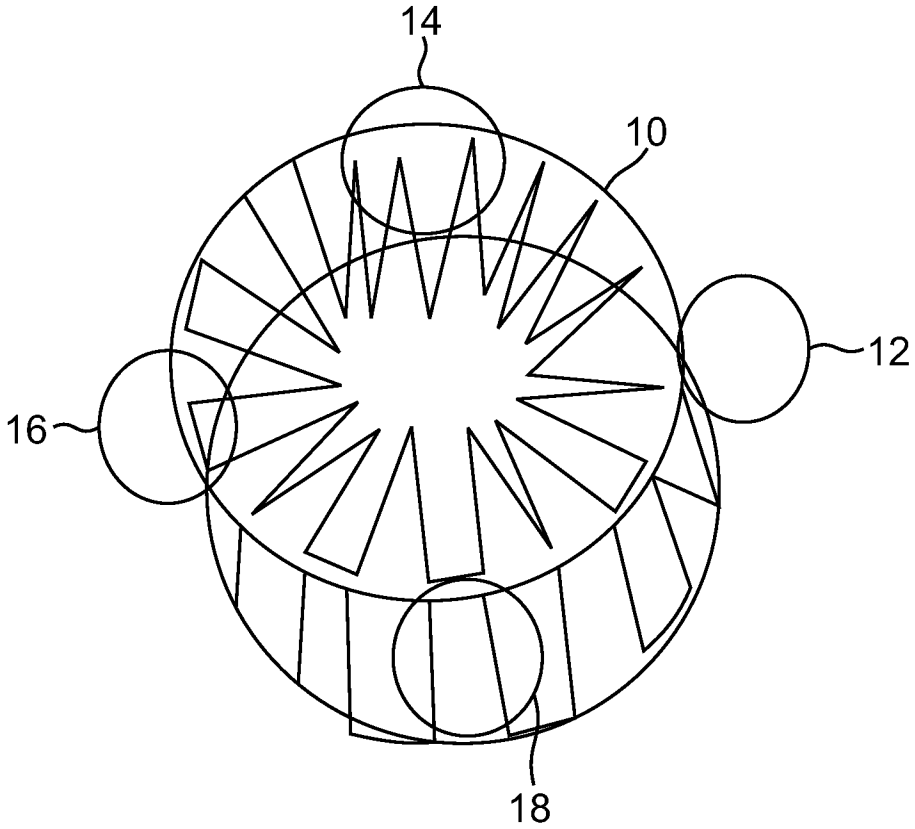
FIG. 4 is a perspective view of the inflated air bladder with four balloon bumps removed from the box illustrated in FIG. 3A.

FIG. 4 is one embodiment of the present invention showing a free standing bellows 10 which is either inflated or partially inflated and is in fluid communication with a multiplicity of separate balloon bumps such as 12, 14, 16 and 18. The balloon bump are used to fill spaces between a corner of a box and the bladder 10F which is designed to fit into the box by itself and is not adhered to the sidewalls of the box. It is possible to have a portion of the bladder adhered to one sidewall. The removable bladder as illustrated in FIG. 4 is also illustrated in a box in FIG. 3A FIG. 3A is a top plan view of a box 200 in the assembled condition with the cover removed to illustrate an embodiment of the present invention air bladder 10 surrounding a fragile object 300 with balloon bumps 12, 14, 16 and 18 located at the four corners of the inflated air bladder 10. For the sake of completeness, the numbering of the walls is as follows. The sidewalls are 200RL1, 200LL1 and the end walls are 200RW1 and 200LW2. The corners are 200RLRW1, 200LLRW1, 200LLLW2 and 200RLLW2. This design may or may not be glued to the box. Also, while the balloon bumps 12, 14, 16 and 18 are shown affixed to the bladder, it is also within the spirit and scope of the present invention to have the balloon bumps 12, 14, 16 and 18 separately inserted at the corner locations as described above.

Figure 3B:
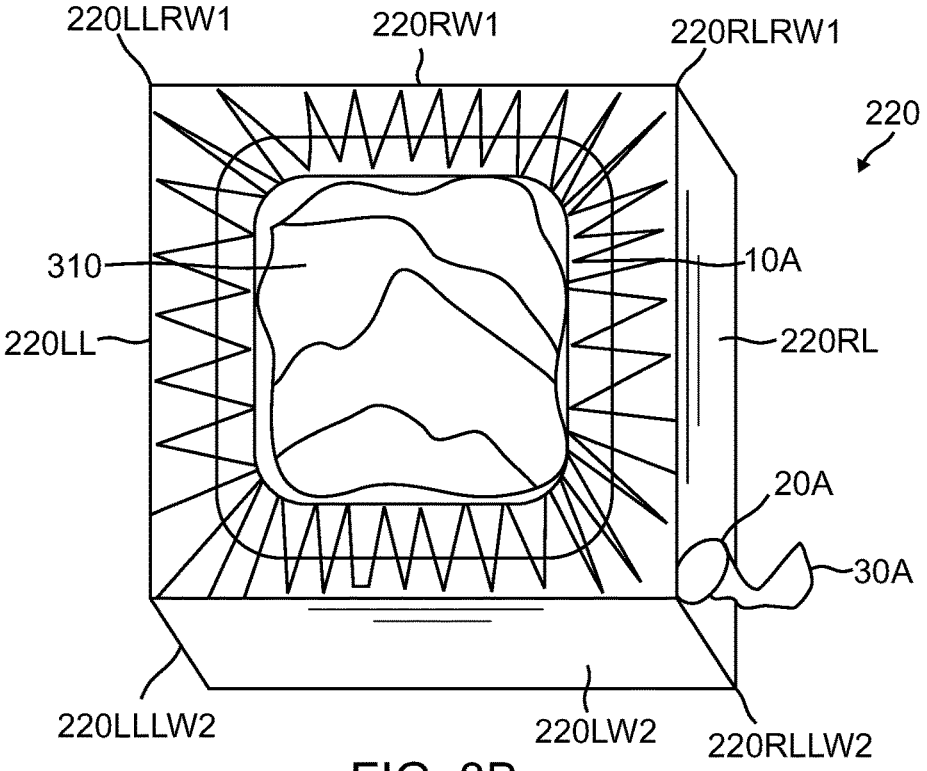
FIG. 3B is a top plan view of a box in the assembled condition with the cover removed to illustrate the present invention inflated air bladder filling up the interior of the box and surrounding a frail object.

FIG. 3B is a top plan view of another box 220 in the assembled condition with the cover removed to illustrate the present invention inflated air bladder 10 filling up the interior of the box and surrounding a frail object 310. Since the bladder 120A extends to the sidewalls 220RL1, 220LL1, 220RW1 and 220LW2 and to respective intersecting corner 220RLRW1, 220LLRW1, 220LLLW2 and 220RLLW2 so no balloon bumps are needed. In this embodiment, the inflatable bladder is designed to adhere to the sidewall of the box such as by adhesive.

Figure 3C:
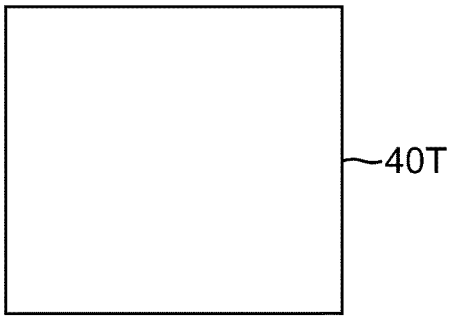
FIG. 3C is to top plan view of a top pillow pad which is used to rest on top of bladder 10 illustrated in FIG. 3A.
Figure 3D:
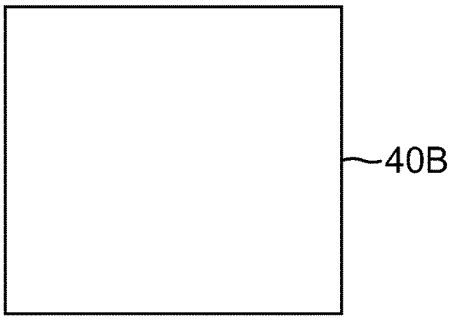
FIG. 3D is bottom plan view of a bottom pillow pad which is used to rest underneath bladder 10 illustrated in FIG. 3A.
Figure 3E:
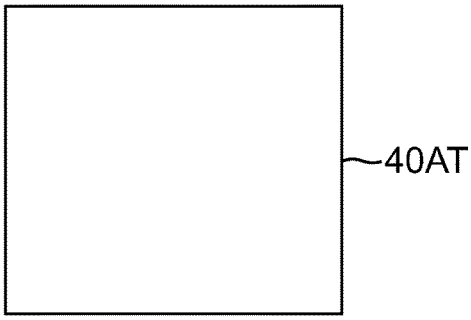
FIG. 3E is a top plan view of a top pillow pad which is used to rest on top of bladder 10A illustrated in FIG. 3B.
Figure 3F:
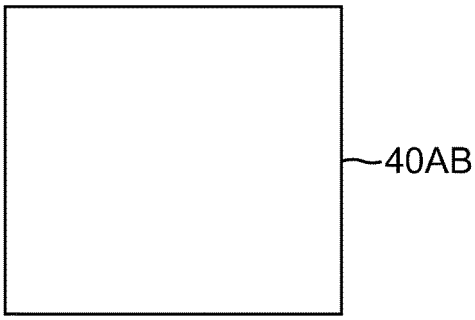
FIG. 3F is a top plan view of a top pillow pad which is used to rest underneath bladder 10A illustrated in FIG. 3F.

Referring respectively to FIGS. 3A and 3B, the boxes can be manufactured as illustrated and can also include a one-way check valve 20 or 20A so that bladder 10 or 10A can be inflated after the box 2200 or 20A is packed. The check valve 20 or 20A can come with a tube 30 or 30A that is bent to allow a customer to let out the air to retrieve the item 300 or 210 and re-inflate the box if the customer decides to return the item 300 or 310. The one-way check valve can either be inserted through the box and then in fluid communication with the bladder or it can be inserted directly into the bladder and then an opening cut in the box so there is access to the one-way check valve through the straw or hose through which air can be inserted into the bladder. Also, as shown in FIG. 2, there can be a kinked straw 70 which is in fluid communication with the bladder and the kinked straw can be unkinked when the box is located at the destination where it is to arrive so the person can unkink the straw 70 and permit the bladder to be deflated. The same straw is used to inflate the bellow to return the item if needed or for the box to be used again for some other shipment. The adjustability of the system allows a range of sizes in the box. A shipping room with several sized items may only need a few size boxes with this design. Referring to FIGS. 3C and 3D, it is possible to add a top pillow pad 40T and a bottom pillow pad 4013 to respectively rest on top of bladder 10 and on bottom of the bladder 10, each of which is a standard pillow pad on the top and the bottom to this design and respectively resting below the top of the box and on top of the bottom of the box when the box 200 is closed. The pillow pads may not be needed if the box is large enough to suspend the object 300. Similarly referring to FIGS. 3E and 3F, it is possible to add a top pillow 40AT and a bottom pillow pad 40AB to respectively rest on top of the bladder 10A and on bottom of the bladder 10A, each of which is a standard pillow pad on the top and bottom of this design and resting below the top of the box and on top of the bottom of the box when the box 220 is closed. The pillow pads may not be needed if the box is large enough to suspend the object 310.

As discussed above, another way to use the present invention is a donut shape as illustrated in FIG. 4, The design includes four balloon bumps 12, 14, 16 and 18 that locate or stretch out into four corners of a box as illustrated in FIG. 3A. These bumps 12, 14, 16 and 18 can be smaller or larger to enable this to work easily in any size box and any size object to be shipped. This would eliminate the number of boxes needed in the shipping room to save cost.

It is also possible to include in this design that the flat strip can be attached to a box or made into a round. The flat strip would have to be pressure-sensitive adhesive backing or special hot melt glue on the sidewall board.

Figure 5:
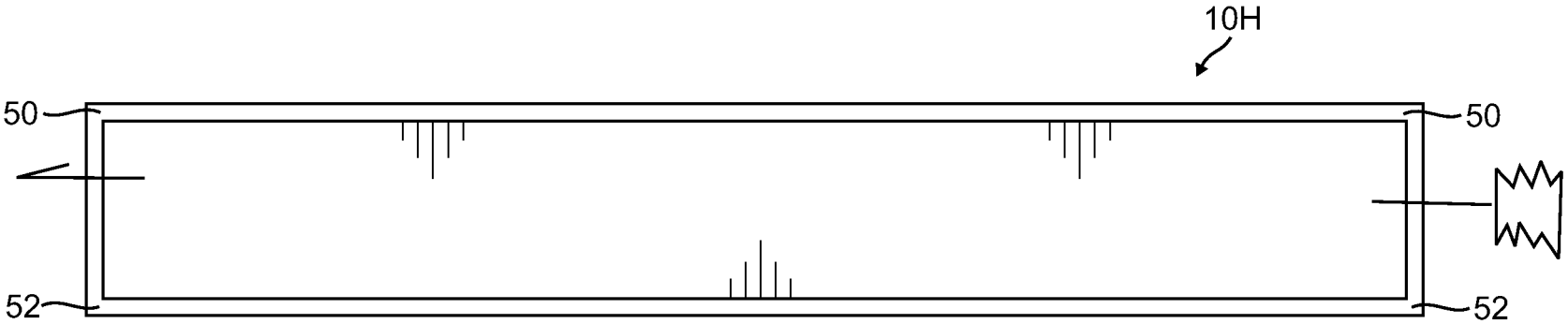
FIG. 5 is a cross-sectional view of a simple heat sealed bladder.
Figure 6:
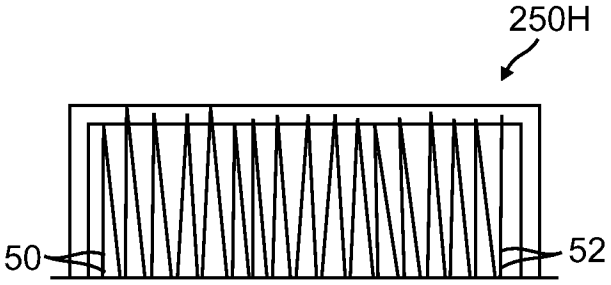
FIG. 6 is a partial cross-section view of an inflated bladder within a seal sealed box.

FIG. 5 is a cross-sectional view of a simple heat sealed bladder 10. FIG. 6 is a partial cross-section view of an inflated bladder within a heat sealed box 250H. The manufacturing of the heat seal bladder part would look like FIG. 5. When made in any number of ways, it could look like FIG. 6 to be attached to the walls of a box or connected end to end or made longer to look like the donut-shaped design. Drawstrings 50 and 52 could be included in the open seams to provide means to compress the inflated bellows from FIG. 5 to FIG. 6. With the drawstring idea, a standard size could be used longer if a small air gap in the box is needed or more compressed if needed to be suspended for very fragile items. The drawstrings could be used to make a donut shape or used to secure the top of the bladder before closing the box.

Insofar as the description above and the accompanying drawing disclose any additional subject matter that is not within the scope of the single claim below, the inventions are not dedicated to the public and the right to the one or more applications to claim such additional inventions is reserved.

The inventor reserves the right to file additional independent and/or dependent claims through a preliminary amendment before a first office action on the merits is issued, to further supplement the claims set forth hereafter.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. An apparatus used in conjunction with a fragile item retained within the apparatus, the apparatus comprising:

a. a first sidewall including an interior surface, a first end wall including an interior surface, a second sidewall including an interior surface, a second end wall including an interior surface, a top wall including an interior surface and a bottom wall including an interior surface, the first sidewall affixed at a first end to a second end of the first end wall and affixed at a second end to a first end of the second end wall, the first end wall further affixed at a first end to a second end of the second sidewall, the second sidewall further affixed at a first end to a second end of the second end wall, the top wall affixed along one side to at least one of the first sidewall, first end wall, second sidewall and second end wall and the bottom wall affixed along one side to at least one of the first sidewall, first end wall, second sidewall and second end wall, the first sidewall, first end wall, second sidewall, second end wall, top wall and bottom wall foldable at respective affixed locations to form a closed box with an interior chamber surrounded by the respective interior surfaces of each respective sidewall, end wall, top wall and bottom wall;

b. a first multiplicity of spaced apart posts affixed at a proximal end to an interior surface sidewall of said box and a distal end of each of the first multiplicity of spaced apart posts extending away from the interior surface of the sidewall and into the interior chamber of a closed box, a second multiplicity of spaced apart top posts respective affixed at a proximal end to the interior surface of the top wall, a distal end of each of the multiplicity of top spaced apart posts extending away from the interior surface of the top wall and into the interior chamber of said box after the box is closed, a respective one of the spaced apart multiplicity of top posts offset from a respective one of the first multiplicity of spaced apart posts;

c. an inflatable bellows, a portion of the inflatable bellows affixed to portion of an interior surface of said box selected from the group consisting of said interior surface of said first sidewall, said first end wall, said second sidewall and said second end wall, said inflatable bellows extending around a portion of each respective multiplicity of first spaced apart posts and each respective multiplicity of top posts and encircling a central interior space of the interior of said box when it is closed, a one-way check valve in fluid communication with said inflatable bellows and extending from said inflatable bellows to a location out of said box, a kinked tube extending through the one-way check valve and in fluid communication with said inflatable bellows and extending from the inflatable bellows to a location out of said box;

d. upon the first sidewall, first end wall, second sidewall, second end wall and bottom wall formed into a box with the top wall not closed, the inflatable bellows and first multiplicity of spaced apart bottom posts surround a portion of the central interior chamber into which the fragile item is inserted and the top wall is moved to a closed position with the multiplicity of spaced apart top posts also partially surrounding the central interior chamber; and e. after the box is closed, air entering the inflatable bellows through the one-way check valve enables the inflatable bellows to expand and concurrently the inflatable bellows moves around a portion of each respective first multiplicity of spaced apart posts and second multiplicity of top posts;

f. whereby, a frangible item is inserted into the central interior space of the box before the box is closed, and after the box is closed, air from the one-way check valve inflates the inflatable bellows to cause the inflatable bellows to be pressed against and suspend the fragile item within the central interior space.

2. The apparatus in accordance with claim 1, further comprising:

a. before the box is closed, four separate balloon bumps are respectively inserted into one of each respective interior four corners of the interior chamber of the box and exterior to the inflatable bellows;

b. whereby, after the box is closed and the inflatable bellows is inflated, the four separate balloon bumps provide additional safety force to further secure the fragile item.

3. The apparatus in accordance with claim 1, further comprising: the kinked tube is un-kinked to deflate the inflatable bellows to enable the fragile item to be removed from the box.

4. The apparatus in accordance with claim 3, further comprising: the kinked tube is un-kinked to force air through the one-way check valve to re-inflate the inflatable bellows to enable the fragile item to be once again suspended by the inflatable bellows.

* * * * *